US005241291A

United States Patent [19]

Blackburn

[11] Patent Number: 5,241,291

[45] Date of Patent: * Aug. 31, 1993

[54] TRANSMISSION LINE FILTER HAVING A VARACTOR FOR TUNING A TRANSMISSION ZERO

[75] Inventor: Dane E. Blackburn, Sunrise, Fla.

[73] Assignee: Motorola, Inc., Schaumburg, Ill.

[ * ] Notice: The portion of the term of this patent subsequent to Aug. 11, 2009 has been disclaimed.

[21] Appl. No.: 726,109

[22] Filed: Jul. 5, 1991

[51] Int. Cl.[5] ..... H01P 7/08; H01P 1/203

[52] U.S. Cl. ..... 333/219; 333/205

[58] Field of Search ..... 333/202-205, 333/219, 235, 246

[56] References Cited

U.S. PATENT DOCUMENTS

| | | | |
|---|---|---|---|
| 3,534,301 | 10/1970 | Golembeski | 333/204 |
| 3,798,578 | 3/1974 | Konishi et al. | 333/234 X |
| 4,157,517 | 6/1979 | Kneisel et al. | 333/205 |
| 4,264,881 | 4/1981 | De Ronde | 333/204 X |
| 4,578,656 | 3/1986 | Lacour et al. | 333/204 |
| 4,609,892 | 9/1986 | Higgins, Jr. | 333/204 |
| 4,661,790 | 4/1987 | Gannon et al. | 333/234 |
| 4,785,271 | 11/1988 | Higgins, Jr. | 333/204 |
| 4,940,955 | 7/1990 | Higgins, Jr. | 333/204 |
| 4,992,759 | 2/1991 | Giraudeau et al. | 333/204 |
| 5,021,757 | 6/1991 | Kobayashi et al. | 333/204 X |
| 5,066,933 | 11/1991 | Komeda | 333/204 |

FOREIGN PATENT DOCUMENTS

| | | | |
|---|---|---|---|
| 0413211 | 2/1991 | European Pat. Off. | 333/219 |
| 0111412 | 6/1984 | Japan | 333/205 |
| 0060303 | 2/1990 | Japan | 333/219 |

*Primary Examiner*—Steven Mottola
*Assistant Examiner*—Seung Ham
*Attorney, Agent, or Firm*—Robert S. Babayi

[57] ABSTRACT

A transmission line structure (100) is provided which includes a resonator (110) having open ends (118) disposed on a substrate (130). The first resonator (110) includes a control voltage terminal (116) which is positioned at a point along the length where a zero potential exists at resonant frequency. Transmission zero frequency is tuned by means of a varactor (150) which is coupled to the control voltage terminal and receives a control voltage for controlling the zero frequency.

12 Claims, 2 Drawing Sheets

TRANSMISSION LINE FILTER HAVING A VARACTOR FOR TUNING A TRANSMISSION ZERO

CROSS REFERENCE TO RELATED APPLICATIONS

This application is related to U.S. patent application Ser. No. 07/676,023, filed Mar. 27, 1991, by Dane E. Blackburn, entitled "Transmission Line Filter Having Tunable Zero" and assigned to Motorola, Inc.

TECHNICAL FIELD

This invention relates generally to the field of transmission line structure and in particular to transmission line resonators having a tunable zero.

BACKGROUND

Filters are extensively used in communication devices, particularly in radio receivers, to provide selectivity for the received signals. A number of factors, including the type and number of resonators in the filter topology, determine the selectivity of a filter. Depending on the application, the filter topology may include any number of quarter-wave resonators, half-wave resonators, or a combination of them.

In order to form a particular filter topology, transmission line filters provide an attractive alternative to filters which utilize discrete components. Conventional stripline or microstrip resonators typically utilize a substrate which is made of ceramic or another dielectric material. For microstrip construction, a conductive runner is formed on one side of the substrate with a ground plane on the other side. The stripline configuration utilizes two such structures with ground planes on the outside and conductive runners therebetween. The resonant frequency of the resonators is determined by such factors as the dielectric constant of the substrate, the thickness of the substrate, and the length and the width of the conductive runner. An inverse relationship exists between the size of the transmission line structure and the resonant frequency of the resonator. That is, for lower resonant frequencies, a substantially longer transmission line structure is needed and vice versa.

A quarter-wave resonator may be produced by providing a ground path at one end of the conductive runner. A half-wave (or a full-wave) resonator may be produced by either grounding both ends of the conductive runner or by providing openings at both ends. The transmission line filter is produced by forming a particular resonator configuration, including different types of resonators, (that is, half-wave or quarter-wave), on the dielectric substrate to create the desired filter topology.

Generally, transmission line filters utilize a number of interdigitated quarter-wave length resonators to provide the desired passband for a specified selectivity. However, the specified selectivity may also be achieved by tuning a transmission zero produced by capacitive coupling of the resonators which are formed in a comb-line arrangement on the filter substrate. Conventionally, the transmission zero frequency is tuned by controlling the capacitive coupling between the resonators by means of varactors which have one terminal coupled to the open ends of each of the resonators and voltage at their other terminals which are coupled to each other. In this arrangement, the DC ground path for the varactors are provided through the grounded end of the quarter-wave resonators. This arrangement, however, requires two varactors and a larger transmission line structure, especially when lower frequency pass band filters in UHF and VHF bands are needed.

In my pending U.S. patent application, Ser. No. 07/676,023 filed on Mar. 27, 1991, and assigned to the Motorola, Inc., the assignee of the present invention, which is hereby incorporated by reference, I disclosed a transmission line structure having two resonators disposed on a substrate. At least one of the two resonators comprises an open ended half-wave resonator. The other resonator has at least one open end. A varactor is disposed between the open ends of the two resonators and controls capacitive coupling therebetween for tuning the transmission zero. The control voltage terminal is positioned along the length of the open ended resonator at a point where a zero potential exists at the resonant frequency. A control voltage applied at this point varies the capacitance of the varactor and may be used to tune the transmission zero. However, because capacitive coupling of the two resonators is varied for tuning, the filter passband is not constant.

Therefore, it is desired to provide a simple, highly-selective filter which may be tuned without affecting its pass band.

SUMMARY OF THE INVENTION

Briefly, according to the invention, a tunable transmission line filter is provided which includes a first resonator having open ends. The first resonator includes a terminal for receiving a control voltage which is positioned along the length of the resonator where a substantially zero potential exists at resonant frequency for receiving a control voltage. A varactor is coupled to the terminal such that the control voltage sets the voltage potential across the varactor to vary its capacitance for tuning transmission zero.

DETAILED DESCRIPTION OF THE PREFERRED EMBODIMENT

Figure 1:
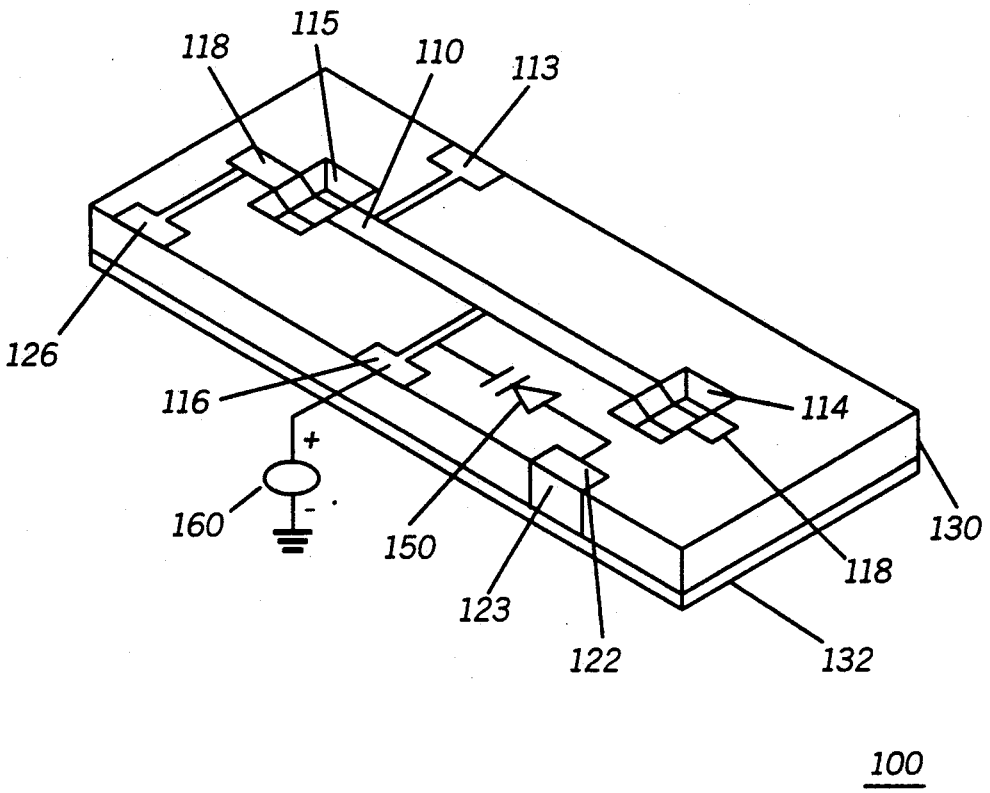
FIG. 1, is an isometric view of one embodiment of the transmission line filter of the present invention.

Referring to FIG. 1, a transmission line structure 100 includes a substrate 130 made of a suitable dielectric material. The substrate 130 has a conductive ground plane 132 disposed on a major bottom surface and a first resonator 110 disposed on a major top surface. In this embodiment, the resonator 110 is formed by dispensing a conductive runner having open ends 118 on the top surface of the substrate 130. The first resonator 110 is sized to behave as a half-wave resonator at a resonant frequency in which the two ends comprise points having radio frequency (RF) voltage points. It is well known that an RF node having zero potential (at the resonant frequency) exists at the center of an open end half-wave resonator.

Preferably, the substrate 130 includes two areas of reduced thickness forming pockets 114 and 115, with the resonator 110 extending at least into these areas. At the pockets 114 and 115, the first resonator 110 is more closely spaced to the ground plane 132, thereby providing increased capacitance and decreased inductance per unit length. The pockets 114 and 115, therefore, make the first resonator 110 capable of operating at low frequencies without the size requirement of conventional resonator designs. A first RF tap 113 is positioned along the length of the resonator 110 where a proper impedance may be presented to external circuitry. A second RF tap 126 is also positioned at a suitable point along the length of the resonator 110 for coupling to the external circuitry. As is well known, the first RF tap 113 and the second RF tap 126 may interchangeably be input and/or output terminals of the transmission line structure 100.

The transmission line structure 100 may be used as a filter having a transmission zero at a frequency. The transmission zero frequency is a frequency at which RF energy reaches its minimum, that is, zero. By tuning the transmission zero frequency, a specified selectivity for the filter may be achieved. According to the invention, the transmission zero frequency is tuned by varying capacitance of a varactor 150. The first resonator 110 includes a control voltage terminal 116 which is positioned at the RF node (that is, a point where a zero RF potential exists at the resonant frequency). Because the first resonator 110 comprises a half-wave resonator, the RF node is positioned at its center. In the preferred embodiment, the varactor 150 is coupled between the control voltage terminal 116 and a ground terminal 122. The ground terminal is coupled to the ground plane 132 by a ground via 123. A DC voltage source 160 is coupled to the control voltage terminal 116 to provide a control voltage for setting the potential across the varactor 150. Because the control voltage is applied at the RF voltage node, the impedance of the control voltage source 160 does not affect the resonator frequency signal propagating through the resonator. The voltage potential across the varactor 150 is set by the control voltage applied to the control voltage terminal 116 which may be varied to vary capacitance of the varactor 150. The transmission zero frequency is partly controlled by the capacitive coupling between the the first resonator 110 and the ground plane 132, therefore, active tuning mechanism for the transmission zero frequency is provided. In this arrangement, because the varactor 150 changes the out-of-band impedance of the resonator 110, the transmission zero may be tuned without effecting the the passband response. It should be noted that, as arranged, the ground potential for the varactor 150 is provided by the ground plane 132. However, it may be appreciated that the varactor 150 may be coupled to a ground potential or a non-ground potential provided by external circuitry.

Figure 2:
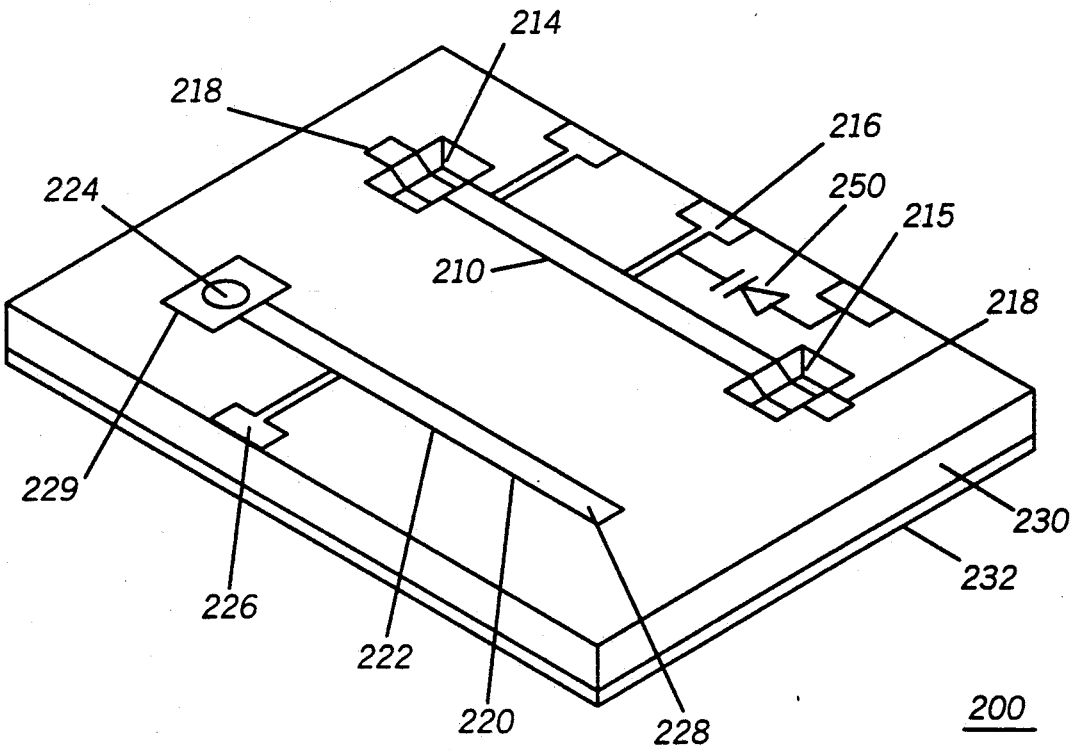
FIG. 2, is an isometric view of another embodiment of the transmission line filter of the present invention.

Referring to FIG. 2, another embodiment of the transmission line filter of the present invention comprises a filter 200. The filter 200 has a first resonator 210 and a second resonator 220 disposed on the top surface of a substrate 230. A ground plane 232 is disposed on a bottom surface by the substrate 230. The first resonator 210 includes open ends 218, pockets 214 and 215, and a control voltage terminal 216 for receiving a control voltage. As described before, the control voltage terminal is positioned at the RF node of the resonator 210 where substantially zero potential exists at resonant frequency. A varactor 250 is coupled between the control voltage terminal 216 and a grounded terminal 215 which is grounded to the ground pane 232 by a ground via (not shown). In this embodiment, the second resonator 220 comprises a runner disposed on the substrate 230 which is shorted to the ground plane 232. The second resonator 220 is grounded at end 229 via a ground-hole 224 and includes an opposing open end 228. The resonator 220, therefore, comprises a quarter-wave resonator. A second RF tap 226 is positioned along the length of the second resonator 220 where the second resonator 220 may present a proper impedance to external circuitry. Accordingly, a transmission line structure is formed by the first resonator 210 having open ends 218 and the second resonator 220 which, in this embodiment of the invention, comprises a quarter-wave resonator having the grounded end 229. The position of the first resonator 210 and the second resonator 220 on the substrate 230 produces a coupling therebetween capacitive and inductive. The coupling of the first resonator 210 and the second resonator 220 effects the position of transmission zero frequency of the filter 200. The varactor 250 is coupled to the RF node of the resonator 210, thus, capacitance variations of the varactor 250 only effect the out-of-band impedance of the resonator 210. Hence, varactor variations have no effect on capacitive coupling between the first resonator 210 and the second resonator 220 which provides a substantially constant passband response for the filter 200. It may be appreciated that the second resonator 220 may comprise an open-ended half-wave resonator as well.

Figure 3:
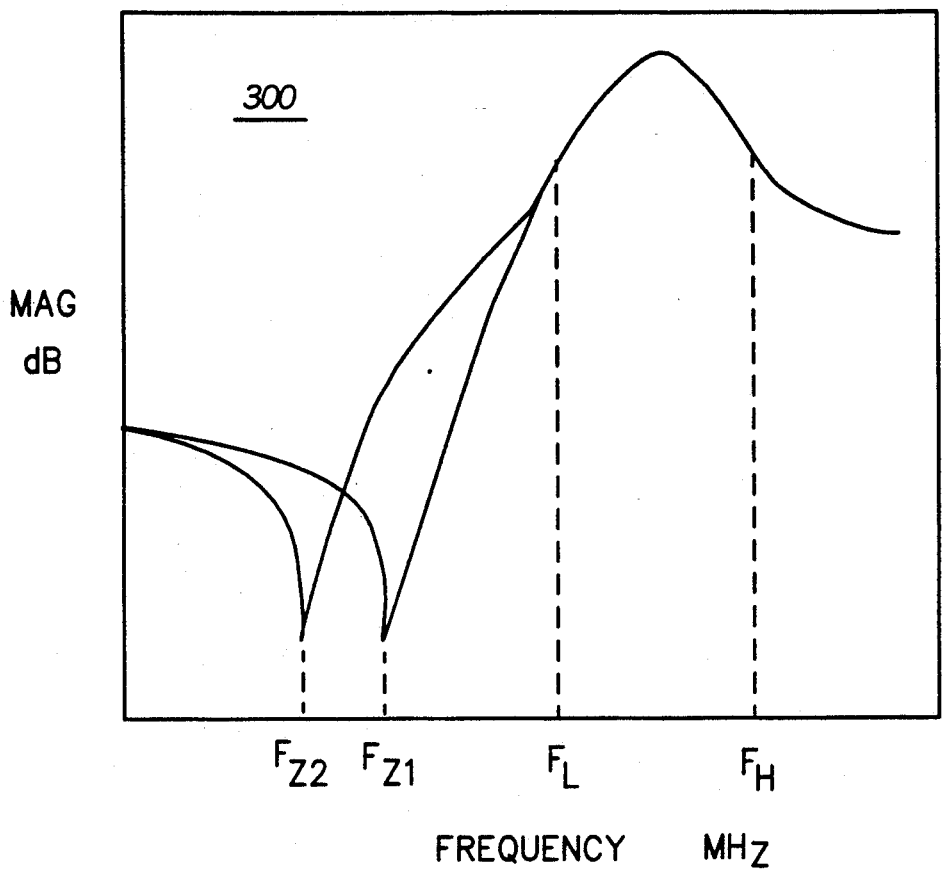
FIG. 3, is a graph of the filter response of the present invention.

Referring to FIG. 3, the frequency response of the transmission line filter of the present invention is depicted by a graph 300. The X-axis of the graph 300 represents the frequency in Mhz and the Y-axis represents transmission magnitude in dB. Tuning of the transmission zero for increasing the selectivity of the filter provides the advantage that during tuning process, low 3 db frequency $F_L$ and the high 3 db frequency $F_H$ are substantially unaffected. As shown, the frequency response of the filter comprises a passband response wherein a transmission zero frequency at $F_{z1}$ is created for a particular varactor capacitance setting. As the varactor capacitance is varied, the transmission zero frequency moves to $F_{z2}$. Accordingly, the selectivity of the filter 100 is increased without substantially affecting the pass band response.

Figure 4:
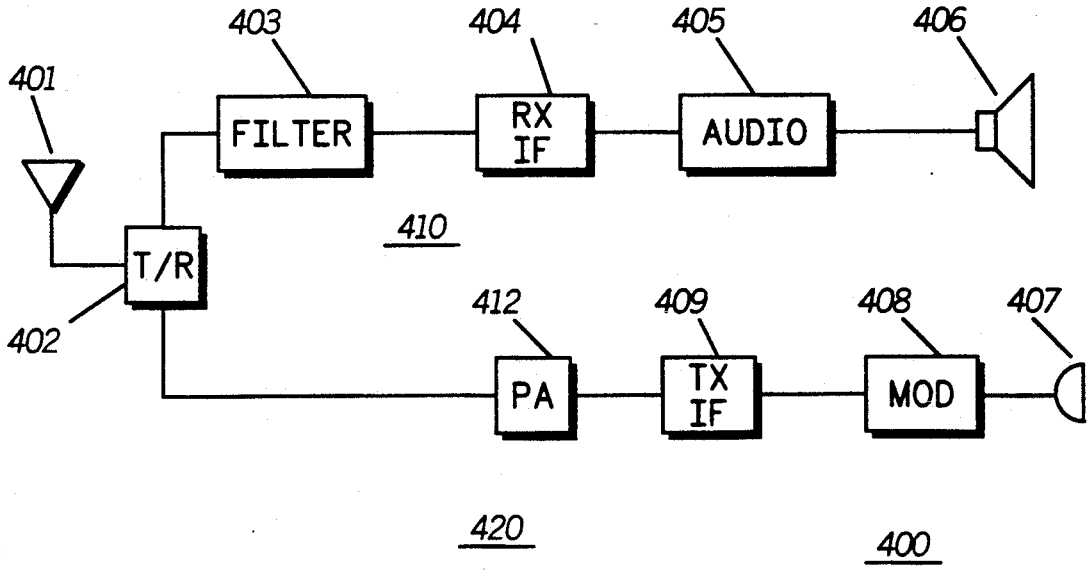
FIG. 4, is a block diagram of a radio which uses the transmission line filter of the present invention.

Referring to FIG. 4, the transmission line filter of the present invention is utilized in a radio 400 comprising any well-known radio, such as a Saber portable two-way radio manufactured by Motorola Inc., which may operate in either receive or transmit modes. The radio 400 includes a receiver section 410 and a transmitter section 420 which comprise means for communicating, that is, transmitting or receiving communication signals for the radio.

In the receive mode, the portable radio 400 receives a communication signal via an antenna 401. A transmit/-receive (T/R) switch 402 couples the received communication signal to a filter 403 which comprises the transmission line filter of the present invention and provides the desired selectivity for the received communication signal. The output of the filter 403 is applied to a well-known receiver IF section 404 which recovers the base band signal. The output of the receiver IF section is applied to a well-known audio section 405 which, among other things, amplifies audio messages and presents them to a speaker 406. It may be appreciated by one of ordinary skill in the art that the control voltage for tuning the transmission zero frequency of the filters 403 may be provided by any suitable means, including a controller means (not shown), which controls the entire operation of the radio 400.

In the transmit mode, audio messages are inputted via a microphone 407, the output of which is applied to a well-known modulator 408 to provide a modulating signal for a transmitter IF section 409. A transmitter power amplifier 412 amplifies the output of the transmitter IF section 409 and applies it to the antenna 401 through the T/R switch 402 for transmission of the communication signal. It may be appreciated that, a transmission line filter, according to the principals of the present invention, may also be utilized in a suitable section of the transmitter section 420. Accordingly, the filters 403 and any filter which may be used in the transmitter section 420 comprise transmission line filters for filtering signals within the communication means, that is, the receiver section 410 and the transmitter section 420.

As described above, the transmission line filter constructed according to the principals of the present invention provides a simple and small size filter which may be utilized in a variety of communication devices. It may be appreciated that the principals of the present invention are equally applicable to stripline or any other suitable transmission line structures.

What is claimed is:

1. A transmission line structure, comprising:

a first resonator having open ends including a control terminal positioned along said resonator where a substantially zero potential exists at resonant frequency; and a varactor having a terminal coupled to said control terminal; said varactor having terminals for receiving a variable control voltage so as to tune a transmission zero by changing out-of-band impedance of the resonator.

2. The transmission line structure of claim 1, further including a second resonator being coupled to the first resonator.

3. The transmission line structure of claim 2, wherein said second resonator has at least one grounded end.

4. The transmission line structure of claim 2, wherein said second resonator has open ends.

5. The transmission line structure of claim 1, wherein said first resonator includes pockets at at least one open end for substantially increasing capacitive loading.

6. The transmission line structure of claim 1, wherein said first resonator comprises a half-wave resonator.

7. A radio comprising:

communication means for communicating communication signals;

a transmission line filter for filtering signals within said communication means comprising:

a first resonator having open ends including a control terminal positioned along said resonator where a substantially zero potential exists at resonant frequency; and a varactor having a terminal coupled to said control terminal; said varactor having terminals for receiving a variable control voltage so as to tune a transmission zero by changing out-of-band impedance of the resonator.

8. A transmission line structure comprising:

a substrate having a ground plane disposed on a major bottom surface;

a first conductive runner disposed on the top surface of said substrate forming a first resonator having open ends including a control terminal for receiving a control voltage; said terminal being positioned at a point along the length of the runner where a substantially zero potential exists at resonant frequency; and a varactor being coupled between said first conductive runner and said ground plane such that said control voltage tunes a tansmission by changing out-of-band impedance of the resonator.

9. The transmission line structure of claim 8 further including a second runner disposed on the substrate forming a second resonator.

10. The transmission line structure of claim 9, wherein said second conductive runner is coupled to said ground plane at one end.

11. The transmission line structure of claim 9, wherein said second conductive runner has open ends.

12. The transmission line structure of claim 9, wherein said substrate includes at least one pocket through which at least one of the first conductive runners or the second conductive runners extend.

* * * * *